US011986034B2

(12) United States Patent
Rafn

(10) Patent No.: US 11,986,034 B2
(45) Date of Patent: May 21, 2024

(54) VENTED LOWER-BODY GARMENT

(71) Applicant: NIKE, Inc., Beaverton, OR (US)

(72) Inventor: Ronald David Rafn, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 0 days.

(21) Appl. No.: 17/086,027

(22) Filed: Oct. 30, 2020

(65) Prior Publication Data

US 2021/0137193 A1 May 13, 2021

Related U.S. Application Data

(60) Provisional application No. 62/934,670, filed on Nov. 13, 2019.

(51) Int. Cl.
*A41D 27/28* (2006.01)
*A41D 1/06* (2006.01)

(52) U.S. Cl.
CPC ..... *A41D 27/28* (2013.01); *A41D 1/06* (2013.01)

(58) Field of Classification Search
CPC ..... A41D 27/28; A41D 1/089; A41D 13/002; A41D 13/0025; A41D 13/0158; A41D 1/06
See application file for complete search history.

(56) References Cited

U.S. PATENT DOCUMENTS 1,255,820 A * 2/1918 Oppenheim ..... A41B 9/08 2/78.2
2,391,535 A * 12/1945 Zelano ..... A41D 27/28 2/93
2,770,810 A 11/1956 De Grazia
3,045,243 A * 7/1962 Lash ..... A41D 27/28 2/1
3,296,626 A 1/1967 Ludwikowski
3,397,407 A * 8/1968 Gallagher ..... A41D 1/06 2/227
3,793,646 A * 2/1974 Tempelhof ..... A41D 1/06 2/227
4,731,883 A 3/1988 Foster
(Continued)

FOREIGN PATENT DOCUMENTS

JP 2004-300618 A 10/2004
KR 200365323 * 10/2004 ..... A41D 1/06
(Continued)

OTHER PUBLICATIONS

Translation of KR 200365323 (Year: 2004).*
(Continued)

*Primary Examiner* — Sally Haden
*Assistant Examiner* — Grady Alexander Nunnery
(74) *Attorney, Agent, or Firm* — Shook, Hardy & Bacon L.L.P.

(57) ABSTRACT

Aspects herein are directed to a vented lower-body garment that includes a plurality of panels that extend at least partially across a back aspect of a first leg portion and a second leg portion, around a medial aspect of the first leg portion and a second leg portion, and at least partially across a front aspect of first leg portion and a second leg portion. Respective edges of the panels overlap each other to form vent openings that facilitate the flow of air into and out of the garment.

13 Claims, 6 Drawing Sheets

(56) References Cited

U.S. PATENT DOCUMENTS

| | | | | |
|---|---|---|---|---|
| 5,303,424 | A * | 4/1994 | Cromartie | A41D 7/005 2/227 |
| 6,161,222 | A * | 12/2000 | Strickland | A41D 1/089 2/228 |
| 7,043,767 | B2 | 5/2006 | Jaeger | |
| D568,580 | S | 5/2008 | Lynch | |
| D621,586 | S | 8/2010 | Hall et al. | |
| D638,609 | S | 5/2011 | Gosse | |
| D655,477 | S | 3/2012 | Robinson | |
| 8,990,970 | B2 | 3/2015 | Lee | |
| D728,898 | S | 5/2015 | Haeberle | |
| 9,375,040 | B2 * | 6/2016 | Rosenbaum | A41D 27/28 |
| 10,045,577 | B2 | 8/2018 | Demarest et al. | |
| 2008/0115252 | A1 * | 5/2008 | Dahan | A41D 31/14 2/79 |
| 2013/0333092 | A1 * | 12/2013 | Hodgson | A41D 3/04 2/243.1 |
| 2015/0313302 | A1 | 11/2015 | Boyle | |
| 2017/0105466 | A1 * | 4/2017 | Baschak | A41D 27/28 |
| 2017/0303605 | A1 * | 10/2017 | Barasa | A41D 31/145 |
| 2018/0279693 | A1 * | 10/2018 | Wipranik | A41D 1/06 |
| 2018/0279704 | A1 | 10/2018 | Cienski et al. | |
| 2019/0119836 | A1 | 4/2019 | Darby | |
| 2019/0274373 | A1 * | 9/2019 | Meyer | A41D 1/06 |

FOREIGN PATENT DOCUMENTS

| | | | | |
|---|---|---|---|---|
| KR | 10-1519103 | * | 5/2015 | A41D 1/06 |
| TW | M412628 | U | 10/2011 | |
| TW | M567574 | U | 10/2018 | |
| WO | 91/03956 | A1 | 4/1991 | |
| WO | 2012/085454 | A1 | 6/2012 | |
| WO | 2017/061053 | A1 | 4/2017 | |

OTHER PUBLICATIONS

"Lululemon Black Crop Pants Back Vents Ruched Legs", poshmark.com, 2019, 1 page.

"Men's Perpetual Cargo Pants", Under Armour, macys.com, 2019, 4 pages.

International Search Report and Written Opinion received for PCT Patent Application No. PCT/US2020/058638, dated Mar. 9, 2021, 12 pages.

International Preliminary Report on Patentability received for PCT Patent Application No. PCT/US2020/058638, dated May 27, 2022, 9 pages.

* cited by examiner

VENTED LOWER-BODY GARMENT

CROSS-REFERENCE TO RELATED APPLICATIONS

This application, entitled "Vented Lower-Body Garment," claims priority to U.S. Provisional Patent Application No. 62/934,670, filed on Nov. 13, 2019, and entitled, "Vented Lower-Body Garment," the entirety of which is incorporated herein by reference.

TECHNICAL FIELD

Aspects herein relate to a vented lower-body garment.

BACKGROUND

Inflow and outflow vents on typical lower-body garments may not be strategically located and/or constructed to maximize the flow of air into the garment and/or the flow of air out of the garment in order to cool a wearer while still preventing, for example, precipitation from entering the garment. Inflow and outflow vents may also not be constructed to minimize material waste.

SUMMARY

The following clauses represent example aspects of concepts contemplated herein. Any one of the following clauses may be combined in a multiple dependent manner to depend from one or more other clauses. Further, any combination of dependent clauses (clauses that explicitly depend from a previous clause) may be combined while staying within the scope of aspects contemplated herein. The following clauses are examples and are not limiting.

Clause 1. A lower-body garment having a torso region defining a waist opening, the lower-body garment comprising: a first leg portion extending from the torso region and having a distal opening, the first leg portion comprising: a first plurality of horizontally oriented panels extending at least partially across a back aspect of the first leg portion, around a medial aspect of the first leg portion, and at least partially across a front aspect of the first leg portion, each of the first plurality of panels including a first terminal end and a second terminal end; and at least a first front panel extending from adjacent the waist opening of the torso region to the distal opening of the first leg portion, the first front panel extending across a first reference line that passes through the first terminal end of at least one of the first plurality of panels and is parallel to a front midline of the lower-body garment.

Clause 2. The lower-body garment according to clause 1, further comprising: a second leg portion extending from the torso region and having a distal opening, the second leg portion comprising: a second plurality of horizontally oriented panels extending at least partially across a back aspect of the second leg portion, around a medial aspect of the second leg portion, and at least partially across a front aspect of the second leg portion, each of the second plurality of panels including a first terminal end and a second terminal end; and at least a second front panel extending from adjacent the waist opening of the torso region to the distal opening of the second leg portion, the second front panel extending across a second reference line that passes through the first terminal end of at least one of the second plurality of panels and is parallel to the front midline of the lower-body garment.

Clause 3. The lower-body garment according to clause 2, further comprising: a waist panel extending across a back aspect of the torso region, wherein the waist panel includes a top edge positioned adjacent to the waist opening and a bottom edge; a first back panel having a top edge and a bottom edge, the bottom edge of the first back panel at least partially forming the distal opening of the first leg portion; and a second back panel having a top edge and a bottom edge, the bottom edge of the second back panel at least partially forming the distal opening of the second leg portion, wherein: the bottom edge of the waist panel overlaps the top edge of each of the first back panel and the second back panel to form a vent opening, and the bottom edge of the waist panel is secured to the top edge of each of the first back panel and the second back panel at two or more spaced-apart securement points.

Clause 4: The lower-body garment according to any of clauses 1 through 3, wherein the first plurality of panels includes an upper panel having a bottom edge, and a lower panel having a top edge, and wherein the bottom edge of the upper panel overlaps the top edge of the lower panel to form a vent opening between the bottom edge and the top edge.

Clause 5. The lower-body garment according to clause 4, wherein the upper panel further includes a top edge, and wherein the top edge of the upper panel is positioned adjacent a crotch region of the lower-body garment.

Clause 6. The lower-body garment according to any of clauses 4 through 5, further comprising a plurality of securement points between the bottom edge of the upper panel and the top edge of the lower panel, the plurality of securement points subdividing the vent opening into a plurality of sub-vent openings.

Clause 7. The lower-body garment according to clause 6, wherein a first sub-vent opening of the plurality of sub-vent openings includes a reinforcement strip extending along a portion of the bottom edge of the upper panel, the reinforcement strip maintaining the first sub-vent opening in an open state.

Clause 8. The lower-body garment according to clause 7, wherein the first sub-vent opening is located on the front aspect of the first leg portion.

Clause 9. The lower-body garment according to any of clauses 7 through 8, wherein a longitudinal axis of the first sub-vent opening is oriented substantially perpendicular to the front midline of the lower-body garment.

Clause 10. A lower-body garment having a torso region defining a waist opening, the lower-body garment comprising: a first leg portion extending from the torso region and having a distal opening, the first leg portion comprising: an upper panel having a bottom edge and extending horizontally and at least partially across a back aspect of the first leg portion, around a medial aspect of the first leg portion, and at least partially across a front aspect of the first leg portion; a lower panel having a top edge and extending horizontally and at least partially across the back aspect of the first leg portion, around the medial aspect of the first leg portion, and at least partially across the front aspect of the first leg portion, wherein the bottom edge of the upper panel overlaps the top edge of the lower panel to form a vent opening between the bottom edge and the top edge; and at least a first front panel that extends from adjacent the waist opening of the torso region to the distal opening of the first leg portion.

Clause 11. The lower-body garment according to clause 10, wherein at least the lower panel includes a first terminal end located on the front aspect of the first leg portion.

Clause 12. The lower-body garment according to clause 11, wherein the first front panel extends across a first reference line that passes through the first terminal end of the lower panel and is parallel to a front midline of the lower-body garment.

Clause 13. The lower-body garment according to any of clauses 10 through 12, further comprising a plurality of securement points between the bottom edge of the upper panel and the top edge of the lower panel, the plurality of securement points subdividing the vent opening into a plurality of sub-vent openings.

Clause 14. The lower-body garment according to clause 13, wherein a first sub-vent opening of the plurality of sub-vent openings includes a reinforcement strip extending along a portion of the bottom edge of the upper panel, the reinforcement strip maintaining the first sub-vent opening in an open state.

Clause 15. The lower-body garment according to clause 14, wherein the first sub-vent opening is located on the front aspect of the first leg portion.

Clause 16. The lower-body garment according to any of clauses 10 through 15, further comprising: a second leg portion extending from the torso region and having a distal opening, the second leg portion comprising: an upper panel having a bottom edge and extending horizontally and at least partially across a back aspect of the second leg portion, around a medial aspect of the second leg portion, and at least partially across a front aspect of the second leg portion; a lower panel having a top edge and extending horizontally and at least partially across the back aspect of the second leg portion, around the medial aspect of the second leg portion, and at least partially across the front aspect of the second leg portion, wherein the bottom edge of the upper panel overlaps the top edge of the lower panel to form a vent opening between the bottom edge and the top edge; and at least a second front panel that extends from adjacent the waist opening of the torso region to the distal opening of the second leg portion.

Clause 17. A method of manufacturing a leg portion of a lower-body garment having a torso region defining a waist opening, the method of manufacturing comprising: positioning an upper panel having a bottom edge such that the upper panel horizontally extends at least partially across a back aspect of the leg portion, around a medial aspect of the leg portion, and at least partially across a front aspect of the leg portion, wherein the upper panel terminates in an upper panel terminal end; positioning a lower panel having a top edge such that the lower panel horizontally extends at least partially across the back aspect of the leg portion, around the medial aspect of the leg portion, and at least partially across the front aspect of the leg portion, wherein the lower panel terminates in a lower panel terminal end, and wherein the upper panel and the lower panel are positioned so that the bottom edge of the upper panel overlaps the top edge of the lower panel to form a vent opening; and securing at least the upper panel terminal end and the lower panel terminal end to a first front panel that extends from adjacent the waist opening of the torso region to a distal opening of the leg portion.

Clause 18. The method of manufacturing the leg portion of the lower-body garment according to clause 17, further comprising securing a first back panel to the first front panel and to at least a portion of the upper panel and the lower panel, wherein the first back panel extends from adjacent the waist opening of the torso region to the distal opening of the leg portion.

Clause 19. The method of manufacturing the leg portion of the lower-body garment according to any of clauses 17 through 18, further comprising securing the bottom edge of the upper panel to the top edge of the lower panel at a plurality of spaced-apart securement points.

Clause 20. The method of manufacturing the leg portion of the lower-body garment according to clause 19, wherein the plurality of spaced-apart securement points divides the vent opening into a plurality of sub-vent openings.

BRIEF DESCRIPTION OF THE DRAWINGS

Examples of aspects herein are described in detail below with reference to the attached drawing figures, wherein.

DETAILED DESCRIPTION

Figure 1A:
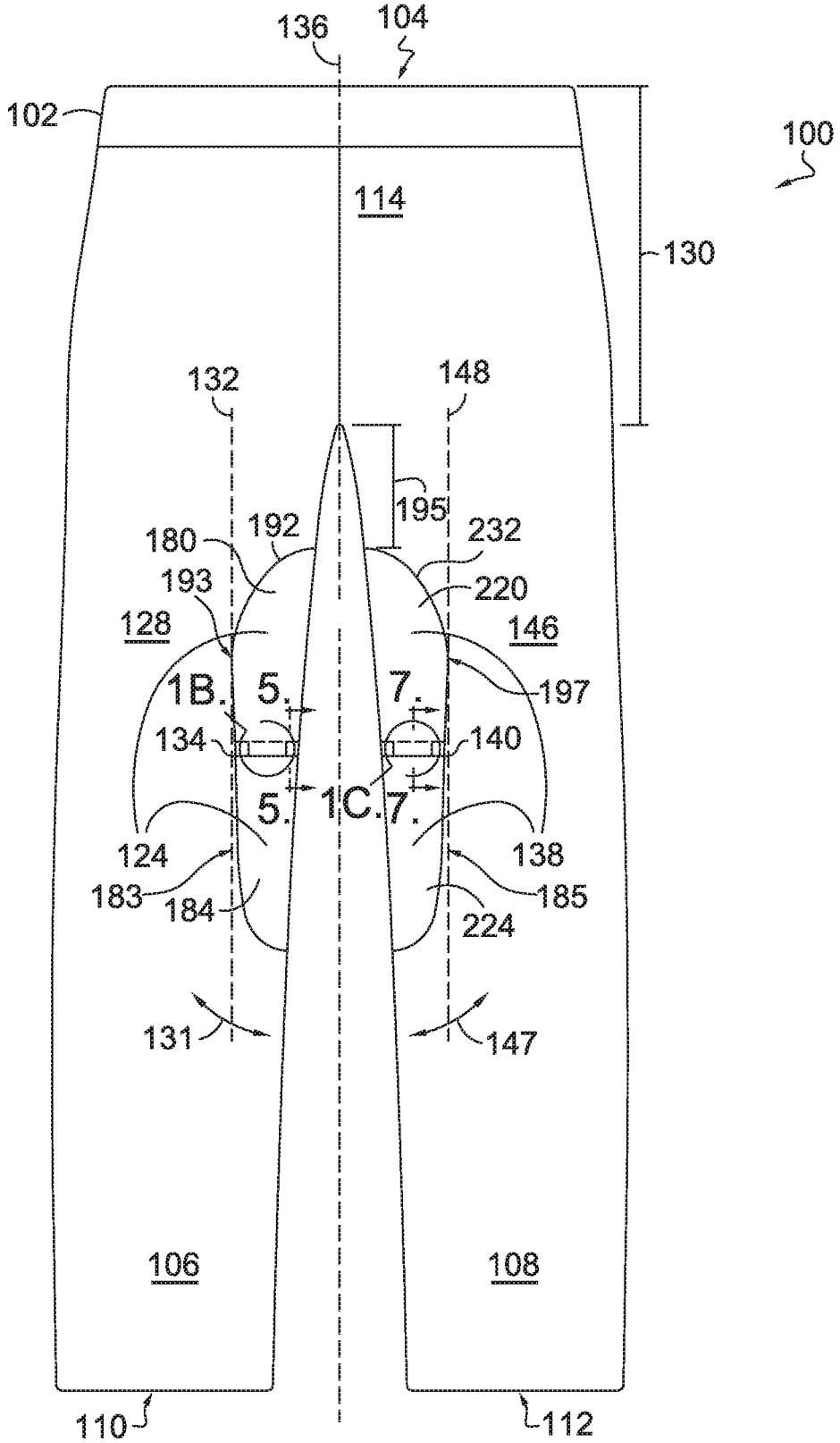
FIG. 1A illustrates a front view of an example vented lower-body garment, in accordance with aspects herein.

The subject matter of the present invention is described with specificity herein to meet statutory requirements. However, the description itself is not intended to limit the scope of this disclosure. Rather, the inventors have contemplated that the claimed or disclosed subject matter might also be embodied in other ways, to include different steps or combinations of steps similar to the ones described in this document, in conjunction with other present or future technologies. Moreover, although the terms "step" and/or "block" might be used herein to connote different elements of methods employed, the terms should not be interpreted as implying any particular order among or between various steps herein disclosed unless and except when the order of individual steps is explicitly stated.

Vents on lower-body garments may include both inflow vents located, for instance, on the front of the lower-body garment that channel air into the space between the garment and the wearer to cool the wearer and outflow vents located, for instance, on the back of the lower-body garment that channel heated air out of the space between the garment and the wearer to further help cool the wearer. Outflow vents on typical lower-body garments are generally offset from or spaced apart from inflow vents by one or more panels of materials that do not include vents. This configuration may retain heated air in the garment for a prolonged period of time. Moreover, when forming the inflow and outflow vents on typical lower-body garments, a first set of panel pieces are generally used to form the inflow vents, and a second separate set of panel pieces are generally used to form the outflow vents which may increase materials costs and manufacturing times. Aspects herein contemplate a lower-body garment with a vented portion formed using overlapping panels that extend at least partially across a back aspect of the leg portions of the garment, around a medial aspect, and at least partially across the front aspect of the leg portions. Thus, the same set of panels form both the inflow vents and the outflow vents on the garment which helps to decrease manufacturing time, costs and material waste. This configuration also results in the outflow vents continuously extending from the inflow vents (i.e., there is no intervening panel(s) between the inflow and outflow vents), so that heated air may more quickly escape the garment. In addition, overlapping the panels helps to prevent precipitation from entering the garment.

At a high level, aspects herein are directed to a lower-body garment having a torso region defining a waist opening, a first leg portion extending from the torso region, and a second leg portion extending from the torso region. In example aspects, the first and second leg portions include a vented portion formed from a plurality of horizontally oriented panels that extend at least partially across a back aspect of each of the leg portions, around a medial aspect of each of the leg portions, and at least partially across a front aspect of each of the leg portions. Each of the plurality of panels include a first terminal end positioned on the front aspect and a second terminal end positioned on the back aspect of the first and second leg portions. The panels are positioned such that, for example, a bottom edge of an upper panel overlaps a top edge of a lower panel to form a vent opening between the respective edges.

In example aspects, the vent opening may be subdivided into a number of sub-vents or sub-vent openings by securing the bottom edge of the upper panel to the top edge of the lower panel at one or more spaced-apart securement points. By utilizing panels that extend partially across the back aspect of the leg portions, around a medial aspect of the leg portions, and at least partially across the front aspect of the leg portions, inflow and outflow vents are formed using the same set of panels. Further, by having the outflow vents continuously extend from the inflow vents, air that enters the garment by way of the inflow vents and is heated by the wearer may quickly escape the garment by way of the outflow vents. Moreover, positioning the panels as described helps to cool the area between a wearer's legs, which is often a high heat-producing area.

Additionally, the lower-body garment may further include a waist panel that extends across a back aspect of the torso region, where the waist panel includes a top edge positioned adjacent to the waist opening and a bottom edge. The bottom edge of the waist panel may overlap the top edge of back panels used to form the leg portions of the lower-body garment to form a vent opening. The vent opening may allow heated air produced by, for instance, the back lower torso region of a wearer to readily escape the lower-body garment thereby helping to cool the wearer.

As used herein, the term "lower-body garment" encompasses garments meant to be worn on a lower torso of a wearer and may include pants, shorts, capris, and the like. Positional terms used when describing the lower-body garment such as front, back, sides, medial, upper, lower, top, bottom, front midline, and the like are with respect to the lower-body garment being worn as intended with the wearer standing upright. As such, when the lower-body garment described herein is worn, a back aspect of the garment is configured to cover a back lower torso area of the wearer and the back of the wearer's legs, a front aspect of the lower-body garment is configured to cover a front lower torso area or the front of the wearer's legs, and the medial sides of the lower-body garment are configured to cover the medial sides of the wearer's legs. A panel that is described as an "upper panel" is located closer to a waist opening of the garment than a panel that is described as a "lower panel." The term "front midline" as used herein means a vertically oriented midline (i.e., a midline that extends from a waist opening to the distal end of the garment) that divides the lower-body garment into generally equal right and left halves. The term "substantially horizontal" when describing how the panels extend across, for instance, the leg portions of the garment or across the back aspect of the torso region means that a longitudinal axis of the panel is oriented perpendicular (within ±20 degrees) to the front midline.

The term "vent" or "vent opening" as used herein means an opening formed in the lower-body garment that provides a fluid (e.g., gas, liquid) communication path between the external environment and the interior of the garment (e.g., the space between the inner-facing surface of the garment and the wearer's body). When using the terms "inflow vent" and "outflow vent" throughout the disclosure, it is contemplated that both encompass a vent opening formed in the lower-body garment but the function of each may differ depending on the location of the vent on the lower-body garment. For example, as used herein, an inflow vent is generally positioned on a portion of the garment that is exposed to a prevailing wind flow caused by, for example, wearer movement. In an example scenario, the inflow vent is positioned on the front aspect of each leg portion of the garment to capture and funnel air into the garment when the wearer is moving in a forward direction (e.g., running). An outflow vent is generally positioned on a portion of the garment that is not exposed to the prevailing wind flow caused by the wearer movement. Thus, in the example scenario above, the outflow vent is generally positioned on the medial side or back aspect of each of the leg portions of the lower-body garment to act as an egress point for air to leave the interior of the garment and exhaust into the external environment. The term "longitudinal axis" used when describing the vent opening is an axis that is parallel to the longest dimension of the vent opening. To state this differently, the "longitudinal axis" of a vent opening linearly extends between adjacent securement points. The term "terminal end" used when describing the panels that form the inflow and outflow vents means the edge of a panel that is continuously joined or seamed to one or more front panels or back panels of the lower-body garment. Unless indicated otherwise, all measurements provided herein are with respect to the garment in a resting state (i.e., a non-stretched) state at standard ambient temperature and pressure (298.15 K and 100 kPa).

Figure 2:
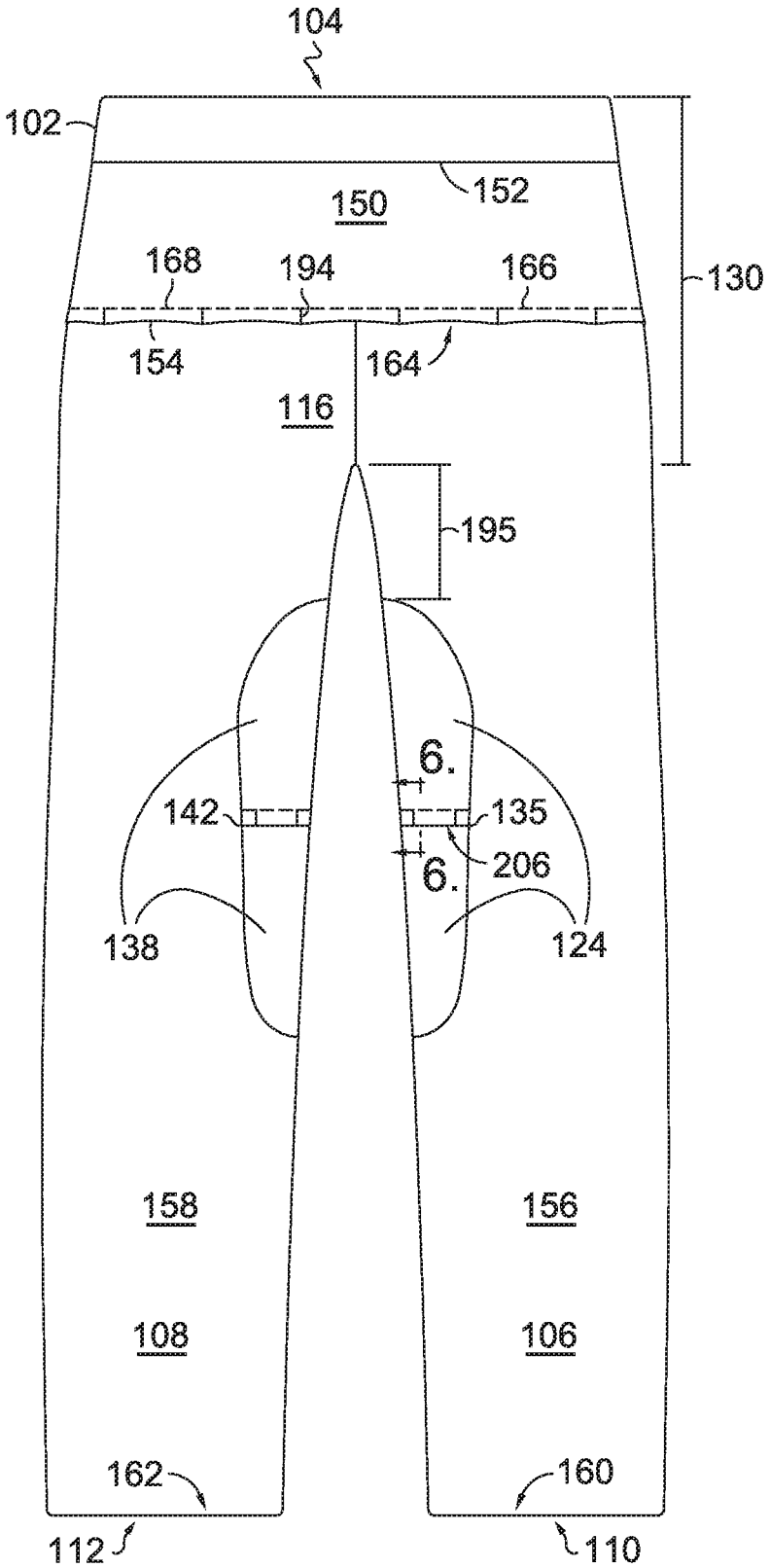
FIG. 2 illustrates a back view of the vented lower-body garment of FIG. 1A, in accordance with aspects herein.
Figure 3:
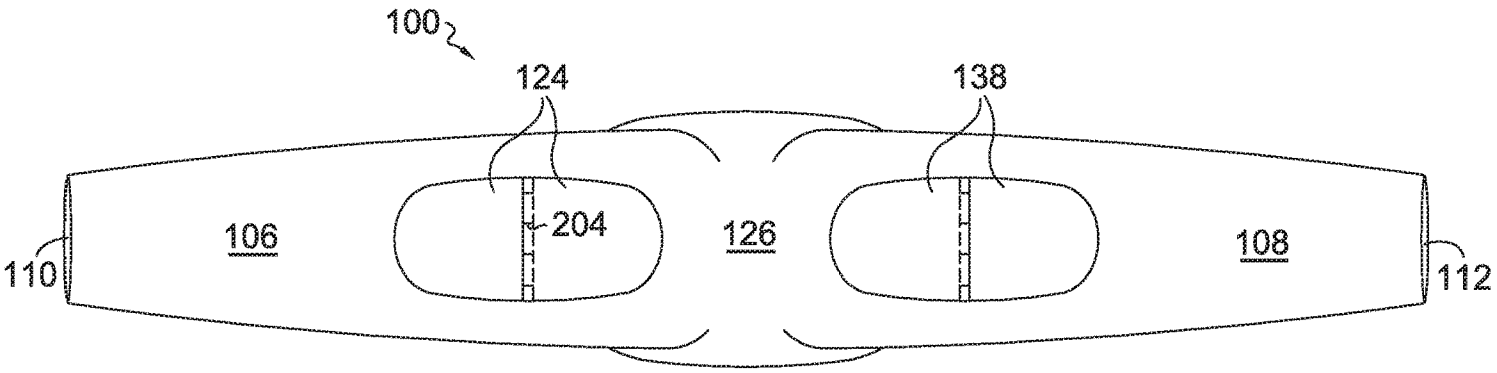
FIG. 3 illustrates a bottom view of the vented lower-body garment of FIG. 1A with the leg portions in a split position to better depict a medial aspect of the leg portions, in accordance with aspects herein.

FIGS. 1A, 2, and 3 respectively illustrate a front view of an example lower-body garment 100, a back view the lower-body garment 100, and a bottom view of the lower-body garment 100 when the leg portions are in a split position to depict the medial sides of the leg portions. A front aspect 114 of the lower-body garment 100 is shown in FIG. 1A, a back aspect 116 of the lower-body garment 100 is shown in FIG. 2, and a medial aspect 126 of the lower-body garment 100 is shown in FIG. 3.

The lower-body garment 100 has a torso region 130 that may optionally include a waistband 102, where the torso region 130 defines a waist opening 104. The lower-body garment 100 also includes a first leg portion 106, and a second leg portion 108 extending distally from the torso region 130. The first leg portion has a distal opening 110, and the second leg portion 108 has a distal opening 112. Although the lower-body garment 100 is shown as pants, it is contemplated herein that the lower-body garment 100 may instead be shorts, capris, leggings, and the like.

In example aspects, the lower-body garment 100 may be formed of a lightweight woven fabric (e.g., from about 30 grams per square meter (gsm) to about 150 gsm) or an ultra-lightweight fabric (e.g., from about 10 gsm to about 100 gsm). As used herein, the term about means within ±5% of an indicated value. The fabric may include a woven textile, and in example aspects, the woven textile may be water-resistant. For example, the woven textile may be treated with a durable water repellant (DWR) finish although other ways of making the woven textile water resistant are contemplated herein. As described, the lower-body garment 100 may be suitable for exercising and/or athletic activities in adverse weather conditions (e.g., rain). It is also contemplated herein that the lower-body garment 100 may be formed of heavier weight materials, other constructions such as a knit textile or a non-woven textile, and/or may not be water-resistant. Any and all aspects, and any variation thereof, are contemplated as being within aspects herein.

As shown in FIGS. 1A, 2 and 3, both the first leg portion 106 and the second leg portion 108 include a vented portion formed from a first plurality of panels 124 and a second plurality of panels 138 respectively that extend partially across the front aspect 114 of the first leg portion 106 and the second leg portion 108 (shown in FIG. 1A), around the medial aspect 126 of the first leg portion 106 and the second leg portion 108 of the lower-body garment 100 (shown in FIG. 3), and partially across the back aspect 116 of the first leg portion 106 and the second leg portion 108 (shown in FIG. 2). Although only two panels are illustrated for the first plurality of panels 124 and the second plurality of panels 138, it is contemplated that in some aspects, there may be additional panels that are similarly situated and form additional vent openings. Each of the first plurality of panels 124 includes a first terminal end 134 positioned on the front aspect 114 of the lower-body garment 100 (shown in FIG. 1A) and a second terminal end 135 positioned on the back aspect 116 of the lower-body garment 100 (shown in FIG. 2). Each of the second plurality of panels 138 also includes a first terminal end 140 positioned on the front aspect 114 of the lower-body garment 100 and a second terminal end 142 positioned on the back aspect 116 of the lower-body garment 100.

Additionally, as seen in FIG. 1A, the lower-body garment 100 includes a first front panel 128 that extends from adjacent the waist opening 104 of the torso region 130 (e.g., within about 0 cm to about 10 cm of the waist opening 104) to the distal opening 110 of the first leg portion 106. The first front panel 128 extends across (e.g., in a lateral-to-medial direction) a first reference line 132 that passes through the first terminal end 134 of at least one of the first plurality of panels 124 and is parallel to a front midline 136 of the lower-body garment 100 as indicated by arrow 131. The lower-body garment 100 also includes a second front panel 146 that extends from adjacent the waist opening 104 of the torso region 130 (e.g., within about 0 cm to about 10 cm of the waist opening 104) to the distal opening 112 of the second leg portion 108. The second front panel 146 extends across (e.g., in a lateral-to-medial direction) a second reference line 148 that passes through the first terminal end 140 of at least one of the second plurality of panels 138 and is parallel to the front midline 136 of the lower-body garment 100 as indicated by arrow 147.

The positioning of first plurality of panels 124 and the second plurality of panels 138 as described and illustrated herein may be based on, for example, heat, sweat, and air flow maps of a human. Thus, these maps may indicate that air flows across the front of humans when, for instance, the humans engage in a running motion, and that humans typically sweat more and/or produce more heat along the medial sides of the wearer's legs. Strategically locating the first plurality of panels 124 and the second plurality of panels 138 at these areas may also simplify construction of the lower-body garment 100 and decrease material waste.

FIG. 3 illustrates how both the first plurality of panels 124 and the second plurality of panels 138 extend continuously and in a generally horizontal direction at least partially across the front aspect 114 of the first and second leg portions 106 and 108, around the medial aspect 126 of the first and second leg portions 106 and 108, and at least partially across the back aspect 116 of the first and second leg portions 106 and 108. As shown in FIG. 3, the configuration and location of the first and second plurality of panels 124 and 138 allow for the inflow and outflow of air through the vents formed. The vented opening formed by the first plurality of panels 124 and the second plurality of panels 138 is continuous from a portion of the front aspect 114 around the medial aspect 126 and to the back aspect 116 of each of the first and second leg portions 106 and 108.

A description will now be provided for an upper panel 180 and a lower panel 184 of the first plurality of panels 124 although it is contemplated herein that the description may be applicable to other panels of the plurality of panels, including the second plurality of panels 138 located on the second leg portion 108. As seen in the magnified view of FIG. 1B, the first plurality of panels 124 includes at least the upper panel 180 having a bottom edge 182 and the lower panel 184 having a top edge 186 (shown in dashed line to indicate it is generally hidden from view by the upper panel 180). The bottom edge 182 of the upper panel 180 overlaps the top edge 186 of the lower panel 184 to form a vent opening 190 between the bottom edge 182 of the upper panel 180 and the top edge 186 of the lower panel 184. More specifically, the bottom edge 182 of the upper panel 180 is positioned external to the top edge 186 of the lower panel 184. Overlapping the panel edges and orienting the panels in a substantially horizontal orientation may help to prevent precipitation from entering the lower-body garment 100 when the wearer is exercising in rainy conditions. When incorporated into the lower-body garment 100, the upper panel 180 includes in an upper panel terminal end 193 (seen in FIG. 1A) and the lower panel includes a lower panel terminal end 183 (seen in FIG. 1A) that are secured to a first front panel 128. Further, the upper panel 180 also includes a top edge 192 (seen in FIG. 1A) that, in example aspects, may be positioned adjacent a crotch region 195 of the lower-body garment 100. As shown in FIG. 1A, the lower panel 184 begins at the vent opening 190, which is between the bottom edge 182 of the upper panel 180 and the top edge 186 of the lower panel 184, and ends at a location midway between the crotch region and the end (e.g., the distal end by the distal opening 100) of the first leg portion 106.

Figure 1B:
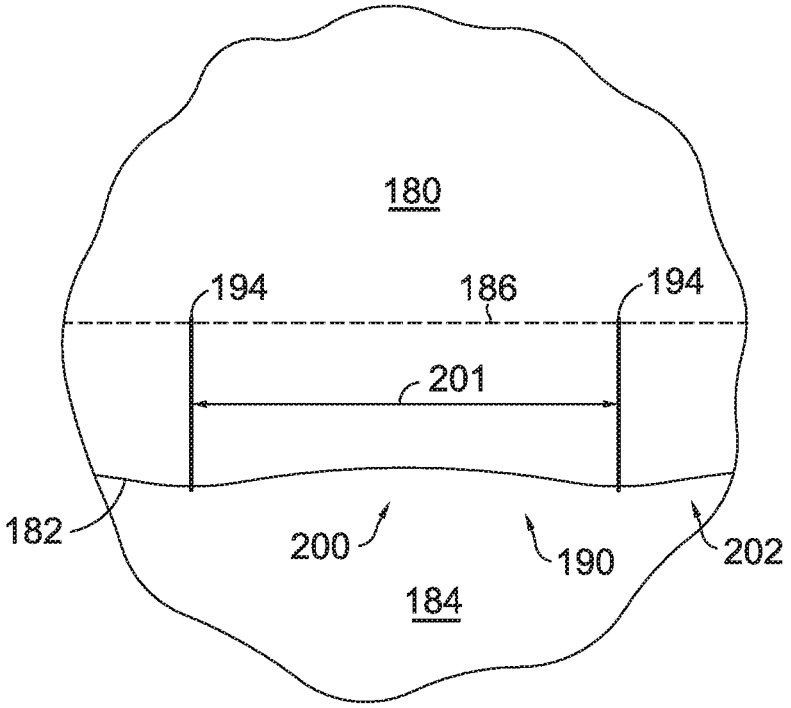
FIG. 1B illustrates a magnified view of a first plurality of panels located on a first leg portion of the vented lower-body garment of FIG. 1A, in accordance with aspects herein.

FIG. 1B further shows the lower-body garment 100 including a plurality of securement points 194 between the bottom edge 182 of the upper panel 180 and the top edge 186 of the lower panel 184. The plurality of securement points 194 subdivide the vent opening 190 into a plurality of sub-vent openings such as a first sub-vent opening 200 and a second sub-vent opening 202. In example aspects, the first sub-vent opening 200 may be located on the front aspect 114 of the first leg portion 106. In example aspects, a longitudinal axis 201 of the sub-vent openings, such as the first sub-vent opening 200, may be oriented substantially perpendicular to the front midline 136 seen in FIG. 1A. Additional sub-vent openings may be located on the medial aspect 126 of the first leg portion 106, such as sub-vent opening 204, or on the back aspect 116 of the first leg portion 106, such as sub-vent opening 206 (seen in FIG. 2).

Figure 1C:
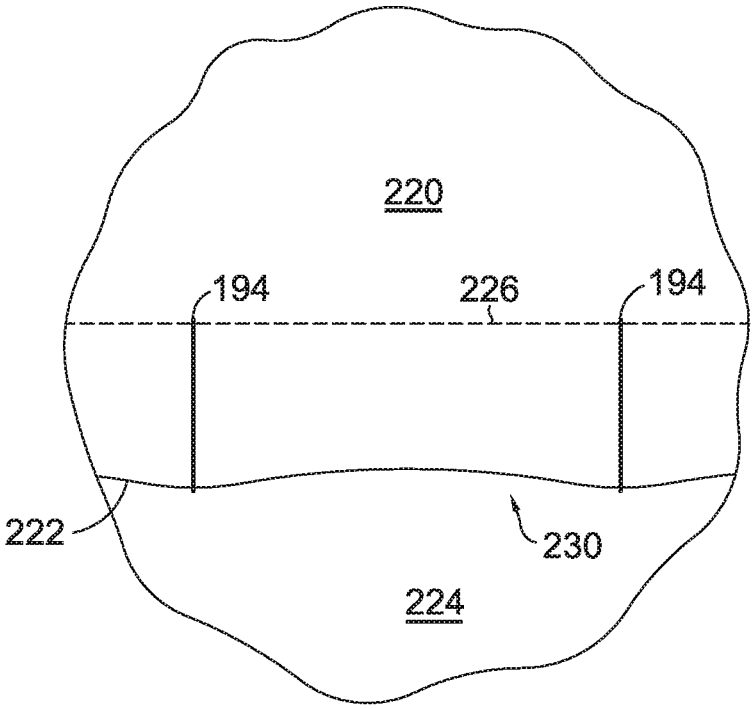
FIG. 1C illustrates a magnified view of a second plurality of panels located on a second leg portion of the vented lower-body garment of FIG. 1A, in accordance with aspects herein.

The second plurality of panels 138 on the second leg portion 108 are similarly configured to the first plurality of panels 124 as shown in the magnified view of FIG. 1C. As such, the second plurality of panels 138 includes at least an upper panel 220 having a bottom edge 222 and a lower panel 224 having a top edge 226 (shown in dashed line to indicate it is generally hidden from view by the upper panel 220). The bottom edge 222 of the upper panel 220 also overlaps the top edge 226 of the lower panel 224 to form a vent opening 230 between the bottom edge 222 of the upper panel 220 and the top edge 226 of the lower panel 224. More specifically, the bottom edge 222 of the upper panel 220 is positioned external to the top edge 226 of the lower panel 224. The upper panel 220 also includes a top edge 232 (seen in FIG. 1A) that is positioned adjacent a crotch region 195 of the lower-body garment 100. Additionally, the upper panel 220 includes an upper panel terminal end 197 (seen in FIG. 1A) and the lower panel 224 includes a lower panel terminal end 185 (seen in FIG. 1A) that are secured to the second front panel 146.

FIG. 1C shows the lower-body garment 100 also including the plurality of securement points 194 between the bottom edge 222 of the upper panel 220 and the top edge 226 of the lower panel 224. The plurality of securement points 194 subdivide the vent opening 230 into a plurality of sub-vent openings similar to those described with respect to FIG. 1B. A first-sub-vent opening may be located on the front aspect 114 of the second leg portion 108. Additional sub-vent openings may be located on the medial aspect 126 of the second leg portion 108 and/or on the back aspect 116 of the second leg portion 108.

The plurality of securement points 194 may be formed by stitching, tacking adhesive, spot welding, bonding, and the like. The spacing between adjacent securement points 194 may be selected to maximize the amount of air entering and leaving the lower-body garment 100 while minimizing opportunities for the vent openings to snag or rip or to make the lower-body garment 100 difficult to don or doff which may occur if the vent openings are too large. In example aspects, the spacing between adjacent securement points 194 may range from about 30 cm to about 5 cm, from about 20 cm to about 8 cm, or from about 15 cm to about 10 cm. In example aspects, the vent openings and/or sub-vent openings positioned on the front aspect 114 of the lower-body garment 100 may function as inflow vents directing air into the lower-body garment 100, and the vent openings and/or sub-vent openings positioned on the back aspect 116 may function as outflow vents for air to escape the lower-body garment 100.

As depicted in FIGS. 1A, 2, and 3, the vent openings, such as the vent opening 190 and the vent opening 230 continuously extend at least partially across the front aspect 114 of the lower-body garment 100, around the medial aspect 126 of the lower-body garment 100, and at least partially across the back aspect 116 of the lower-body garment 100. Having a continuous vent opening that can function as both an inflow vent (when, for instance, located on the front aspect 114 of the lower-body garment 100) and as an outflow vent (when, for instance, located on the back aspect 116 of the lower-body garment 100) minimizes the number of pattern pieces needed to form, for example, separate inflow vents and outflow vents. In addition, having a continuous vent opening facilitates a continuous flow of air into and out of the lower-body garment 100. Thus, air entering the lower-body garment 100 by way of the vent opening positioned on the front aspect 114 of the lower-body garment 100 may exit the lower-body garment 100 by way of the vent opening positioned on the medial aspect 126, or the back aspect 116 of the lower-body garment 100. In one illustrative example, a volume of air entering the lower-body garment 100 by way of the vent opening positioned on the front aspect 114 may be heated by the wearer. The warmed air may begin exiting the lower-body garment 100 by way of the vent opening positioned on the medial aspect 126 and finish exiting the lower-body garment 100 on the back aspect 116 of each of the first and second leg portions 106 and 108. The continuous exhaust of warmed air along the medial aspect 126 and the back aspect 116 of the lower-body garment 100 may allow for more efficient venting and cooling of the wearer.

Figure 4:
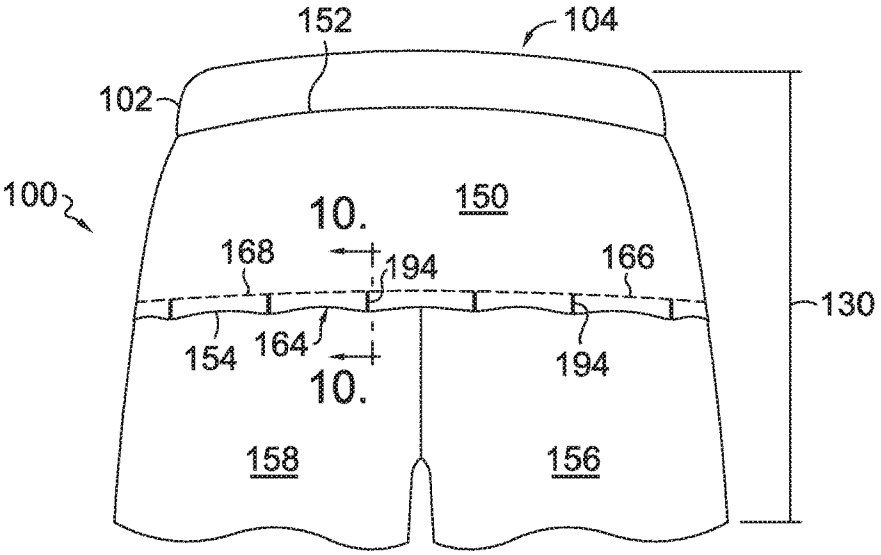
FIG. 4 illustrates a back view of a torso region of the vented lower-body garment of FIG. 1A, in accordance with aspects herein.

In addition to the vented portions on the first leg portion 106 and the second leg portion 108, the lower-body garment 100 may optionally include a waist panel 150 that extends across the back aspect 116 of the torso region 130 in a generally horizontal orientation, as shown in FIGS. 2 and 4. The waist panel 150 includes a top edge 152 positioned adjacent to the waist opening 104 (e.g., within about 0 cm to about 10 cm of the waist opening 104) and a bottom edge 154 that is spaced further below the waist opening 104 as compared to the top edge 152 of the waist panel 150. Additionally, the lower-body garment 100 further comprises a first back panel 156 that forms, at least in part, the back aspect 116 of the first leg portion 106 and a second back panel 158 that forms, at least in part, the back aspect 116 of the second leg portion 108. The first back panel 156 has a top edge 166 and a bottom edge 160 (shown in FIG. 2) that, together with a bottom edge of the first front panel 128 forms the distal opening 110 of the first leg portion 106. Similarly, the second back panel 158 has a top edge 168 and a bottom edge 162 (shown in FIG. 2) that, together with a bottom edge of the second front panel 146, forms the distal opening 112 of the second leg portion 108. The top edges 166 and 168 of the first back panel 156 and the second back panel 158 respectively, are shown in dashed line to indicate they are generally hidden from view by the waist panel 150. The bottom edge 154 of the waist panel 150 overlaps the top edges 166 and 168 of each of the first back panel 156 and the second back panel 158 to form a vent opening 164. The bottom edge 154 of the waist panel 150 is secured to the top edge 166 of the first back panel 156 and the top edge 168 of the second back panel 158 at two or more spaced-apart securement points 194. The vent opening 164 allows heated air produced by the back lower torso region of a wearer to readily escape the lower-body garment thereby helping to cool the wearer.

Figure 5:
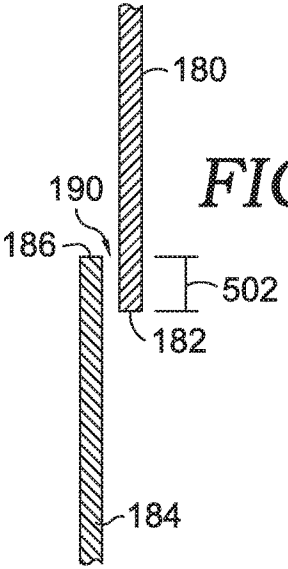
FIG. 5 illustrates a cross-section of a vent taken at cut line 5-5 of FIG. 1A, in accordance with aspects herein.

FIG. 5 illustrates a cross-section of the vent opening 190 taken along cut line 5-5 in FIG. 1A. The description of FIG. 5 is equally applicable to the vent opening 230 on the second leg portion 108. FIG. 5 depicts the bottom edge 182 of the upper panel 180 overlapping the top edge 186 of the lower panel 184 to form the vent opening 190. The vent opening 190 represents an area where the bottom edge 182 of the upper panel 180 is not affixed to, or is unaffixed from, the top edge 186 of the lower panel 184 to provide a fluid communication path between an environment external to the lower-body garment 100 and an environment internal to the lower-body garment 100. Overlapping the edges of the panels may prevent precipitation from entering the lower-body garment 100. As shown, the bottom edge 182 of the upper panel 180 is positioned external to the top edge 186 of the lower panel 184. The amount of overlap between the bottom edge 182 of the upper panel 180 and the top edge 186 of the lower panel 184 is indicated by reference numeral 502. The amount of overlap can range from about 5 cm to about 4 mm, from about 4 cm to about 6 mm, from about 3 cm to about 8 mm, or from about 2 cm to about 1 cm.

Figure 6:
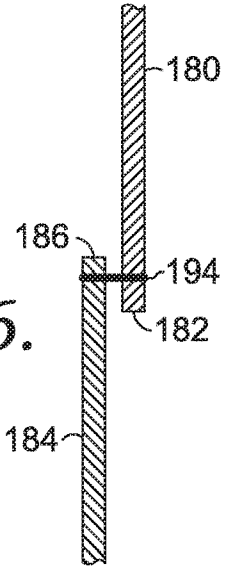
FIG. 6 illustrates a cross-section of a vent including a securement point taken along cut line 6-6 of FIG. 2, in accordance with aspects herein.

FIG. 6 illustrates a cross-section of the vent opening 190 taken along cut line 6-6 of FIG. 2. The discussion of FIG. 6 is equally applicable to the vent opening 230 on the second leg portion 108. FIG. 6 illustrates the securement point 194 that secures the bottom edge 182 of the upper panel 180 to the top edge 186 of the lower panel 184 at spaced-apart locations along the vent opening 190. The securement point 194, in example aspects, may comprise a stitch as shown. In other example aspects, the securement point 194 may be formed using bonding, adhesives, releasable fasteners such as snaps, buttons, hook-and-loop fasteners, and the like.

Figure 7:
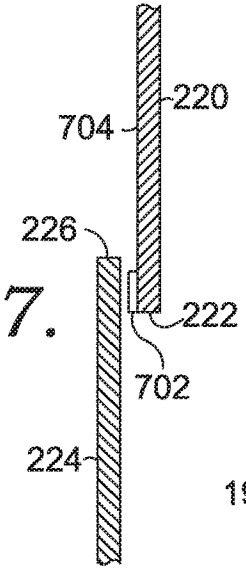
FIG. 7 illustrates a cross-section of a vent including a reinforcement strip taken along cut line 7-7 of FIG. 1A, in accordance with aspects herein.

FIG. 7 illustrates a cross-section of the vent opening 230 on the front aspect 114 of the second leg portion 108 of the lower-body garment 100 taken along cut line 7-7 of FIG. 1A. The discussion of FIG. 7 is equally applicable to the vent opening 190 located on the front aspect 114 of the first leg portion 106. With respect to FIG. 7, a reinforcement strip 702 may optionally be applied to an inner-facing surface 704 of the bottom edge 222 of the upper panel 220 and is used to maintain the vent opening 230 and/or the sub-vent openings in an open state. As mentioned, the front aspect 114 of the lower-body garment 100 may be exposed to prevailing wind flow when a wearer is moving forward, and the use of the reinforcement strip 702 prevents the vent opening 230 from collapsing when exposed to the prevailing wind flow. The reinforcement strip 702 may be formed from a variety of materials including rigid materials and flexible materials such as rubber, silicone, polyurethane, thermoplastic polyurethane, wire or metal, plastic, a textile (knit, woven or non-woven), and the like. In example aspects, the use of one or more reinforcement strips 702 may be limited to the vent opening 190 and/or sub-vent openings positioned on the front aspect 114, although aspects herein further contemplate use of one or more reinforcement strips 702 on the back aspect 116 of each of the first leg portion 106 and the second leg portion 108 and/or the medial aspect 126 of each of the first leg portion 106 and the second leg portion 108. Any and all aspects, and any variation thereof, are contemplated as being within aspects herein.

Figure 8:
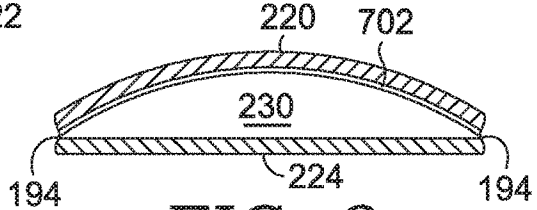
FIG. 8 illustrates a view of a vent opening including a reinforcement strip taken along a longitudinal axis of the vent opening, in accordance with aspects herein.

FIG. 8 illustrates a view of the vent opening 230 of FIG. 7 taken along the longitudinal axis of the vent opening 230. The discussion of FIG. 8 is equally applicable to the vent opening 190 located on the front aspect 114 of the first leg portion 106. In example aspects, the reinforcement strip 702 may have a permanent arch shape to facilitate maintaining the vent opening 230 in the open state. In other example aspects, the reinforcement strip 702 may be formed from a flexible material that is straight in an unbiased state. When incorporated into the vent opening 230, the reinforcement strip 702 may be biased between adjacent securement points 194 to cause the reinforcement strip 702 to assume an arch shape. Any and all aspects, and any variation thereof, are contemplated as being within aspects herein.

Figure 9:
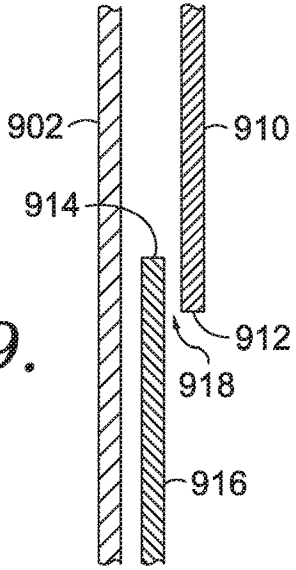
FIG. 9 illustrates an example cross-section of a vent including a mesh liner layer, in accordance with aspects herein.

FIG. 9 illustrates an alternative construction where a mesh liner layer 902 is positioned internal to at least the first plurality of panels 124 and/or the second plurality of panels 138. FIG. 9 depicts an upper panel 910 having a bottom edge 912 that overlaps a top edge 914 of a lower panel 916 to form a vent opening 918. The mesh liner layer 902 is positioned internal to the upper panel 910 and the lower panel 916. It is contemplated herein that the mesh liner layer 902 may be unaffixed from the upper panel 910 and the lower panel 916, or the mesh liner layer 902 may be tacked or secured to one or more of the upper panel 910 and the lower panel 916 at one or more locations. The mesh liner layer 902 may include a loosely knit or woven structure having a plurality of closely-spaced openings, or the mesh liner layer may include a fabric (knit, woven, non-woven) through which a plurality of holes are formed (e.g., by way of laser cutting, incising, die punch, and the like). The mesh liner layer 902 may be useful for preventing particulate matter from entering the lower-body garment by way of the vent opening 190 while still maintaining the lightweight characteristics and breathability/permeability characteristics of the lower-body garment. The mesh liner layer 902 may be limited to areas of the garment that include the panels that form the vent structure. Alternatively, the entirety or substantial entirety of the lower-body garment may be lined with the mesh liner layer in example aspects. Any and all aspects, and any variation thereof, are contemplated as being within aspects herein.

Figure 10:
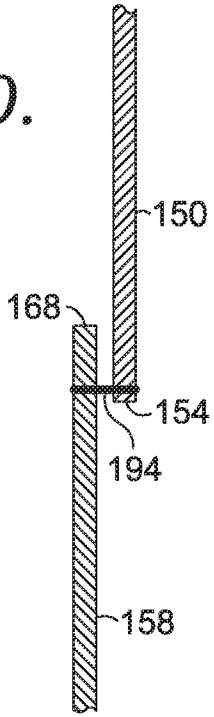
FIG. 10 illustrates a cross-section of a vent taken along cut line 10-10 of FIG. 4, in accordance with aspects herein.

FIG. 10 illustrates a cross-section of the vent opening 164 on the back aspect 116 of torso region 130 of the lower-body garment taken at cut line 10-10 of FIG. 4. As seen in FIG. 10, securement point 194 secures the bottom edge 154 of the waist panel 150 to the top edge 168 of the second back panel 158 at spaced apart locations along the vent opening 164. Additionally, securement point 194 secures the bottom edge 154 of the waist panel 150 to the top edge 166 of the first back panel 156 at spaced apart locations along the vent opening 164 (not shown).

Figure 11:
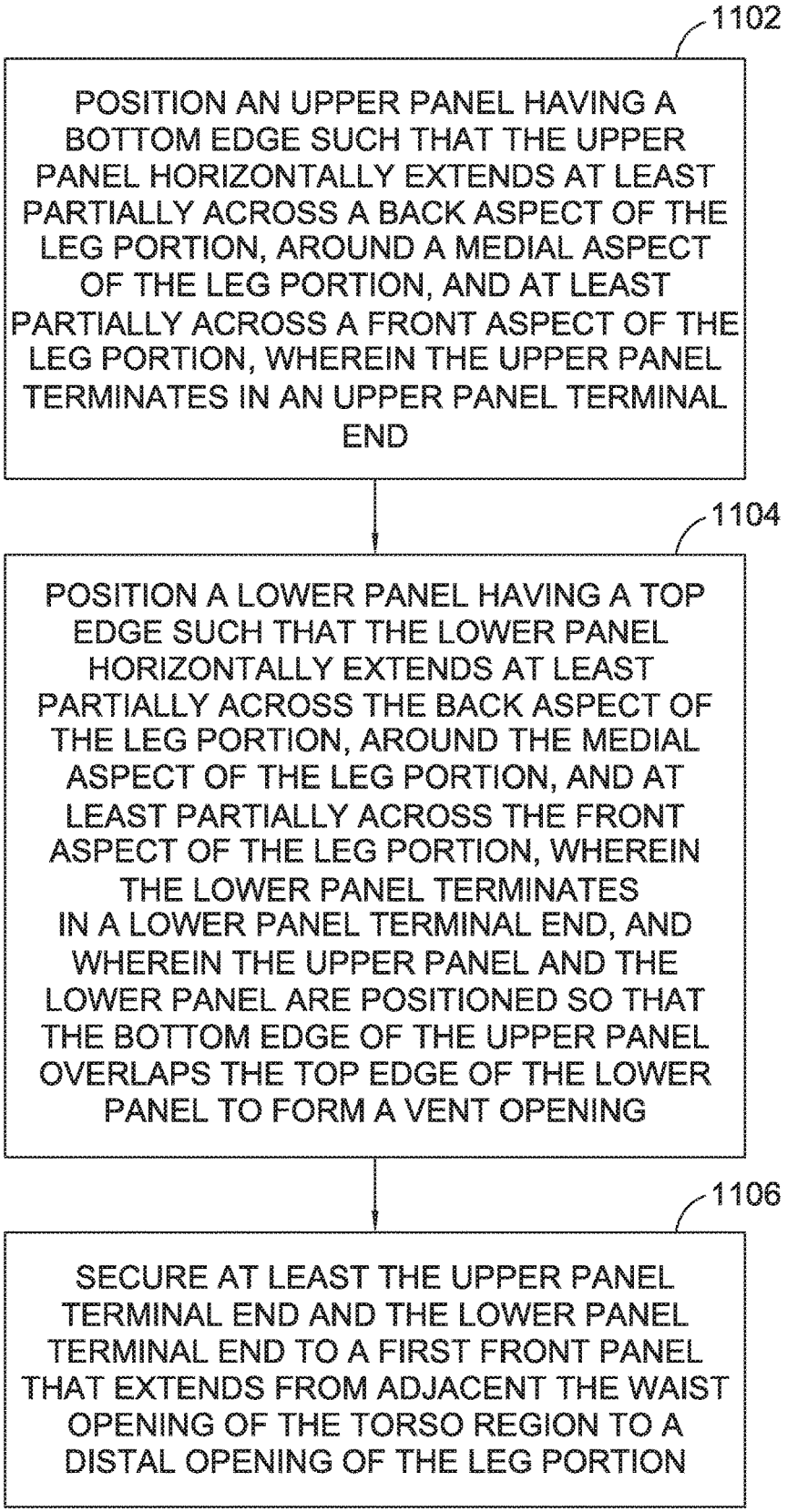
FIG. 11 illustrates a flow diagram of an example method of manufacturing a vented portion of a lower-body garment, in accordance with aspects herein.

FIG. 11 depicts a flow diagram of an example method 1100 of manufacturing a vented portion of a lower-body garment such as the lower-body garment 100. The lower-body garment includes a torso region, such as the torso region 130 that defines a waist opening, such as the waist opening 104. The lower-body garment further includes a first leg portion, such as the first leg portion 106, and a second leg portion, such as the second leg portion 108, that each extend distally from the torso region. At block 1102, an upper panel having a bottom edge, such as the upper panel 180 and/or the upper panel 220, is positioned so that it horizontally extends at least partially across a back aspect of the leg portion, around a medial aspect of the leg portion, and at least partially across a front aspect of the leg portion. The upper panel of the leg portion terminates in an upper panel terminal end, such as upper panel terminal end 193 and/or upper panel terminal end 197 on the front aspect of the first and/or second leg portions.

At block 1104, a lower panel having a top edge, such as the lower panel 184 and/or the lower panel 224, is positioned such that the lower panel horizontally extends at least partially across the back aspect of the leg portion, around the medial aspect of the leg portion, and at least partially across the front aspect of the leg portion. In aspects, the lower panel terminates in a lower panel terminal end, such as lower panel terminal end 183 and/or lower panel terminal end 185, on the front aspect of the first and/or second leg portion. The upper panel and the lower panel are positioned so that the bottom edge of the upper panel overlaps the top edge of the lower panel to form a vent opening.

At step 1106, the upper panel terminal end and the lower panel terminal end are secured to a front panel, such as the first front panel 128 and/or the second front panel 146, that extends from adjacent the waist opening of the torso region to a distal opening of the leg portion.

Aspects of the present disclosure have been described with the intent to be illustrative rather than restrictive. Alternative aspects will become apparent to those skilled in the art that do not depart from its scope. A skilled artisan may develop alternative means of implementing the aforementioned improvements without departing from the scope of the present disclosure.

It will be understood that certain features and subcombinations are of utility and may be employed without reference to other features and subcombinations and are contemplated within the scope of the claims. Not all steps listed in the various figures need be carried out in the specific order described.

What is claimed is:

1. A lower-body garment having a torso region defining a waist opening, the lower-body garment comprising:

a first leg portion extending from the torso region and having a distal opening, the first leg portion comprising:

a first plurality of horizontally oriented panels extending at least partially across a back aspect of the first leg portion, around a medial aspect of the first leg portion, and at least partially across a front aspect of the first leg portion, each of the first plurality of horizontally oriented panels including a first terminal end and a second terminal end, the first plurality of horizontally oriented panels including an upper panel having a top edge and a bottom edge, wherein the top edge is adjacent and spaced apart from a crotch region of the lower-body garment, wherein the crotch region is located where each of the first leg portion and a second leg portion extend from the torso region of the lower-body garment, and a lower panel having a top edge, and wherein the bottom edge of the upper panel overlaps the top edge of the lower panel from 4 mm to 4 cm to form a vent opening between the bottom edge and the top edge, and wherein the vent opening extends continuously in a horizontal direction from a portion of the front aspect around the medial aspect and to the back aspect of the first leg portion, and wherein a mesh liner layer is positioned internal to the upper panel and the lower panel, wherein the lower panel begins at the vent opening, which is between the bottom edge of the upper panel and the top edge of the lower panel, and ends at a location midway between the crotch region and an end of the first leg portion, and wherein at least a first front panel extending from adjacent the waist opening of the torso region to the distal opening of the first leg portion, the first front panel extending across a first reference line that passes through the first terminal end of at least one of the first plurality of horizontally oriented panels and is parallel to a front midline of the lower-body garment; and a second leg portion extending from the torso region and having a distal opening, the second leg portion comprising:

a second plurality of horizontally oriented panels extending at least partially across a back aspect of the second leg portion, around a medial aspect of the second leg portion, and at least partially across a front aspect of the second leg portion, each of the second plurality of horizontally oriented panels including a first terminal end and a second terminal end; and at least a second front panel extending from adjacent the waist opening of the torso region to the distal opening of the second leg portion, the second front panel extending across a second reference line that passes through the first terminal end of at least one of the second plurality of horizontally oriented panels and is parallel to the front midline of the lower-body garment.

2. The lower-body garment of claim 1, further comprising:

a waist panel extending across a back aspect of the torso region, wherein the waist panel includes a top edge positioned adjacent to the waist opening and a bottom edge;

a first back panel having a top edge and a bottom edge, the bottom edge of the first back panel at least partially forming the distal opening of the first leg portion; and a second back panel having a top edge and a bottom edge, the bottom edge of the second back panel at least partially forming the distal opening of the second leg portion, wherein:

the bottom edge of the waist panel overlaps the top edge of each of the first back panel and the second back panel to form a vent opening, and the bottom edge of the waist panel is secured to the top edge of each of the first back panel and the second back panel at two or more spaced-apart securement points.

3. The lower-body garment of claim 1, further comprising a plurality of securement points between the bottom edge of the upper panel and the top edge of the lower panel, the plurality of securement points subdividing the vent opening into a plurality of sub-vent openings.

4. The lower-body garment of claim 3, wherein a first sub-vent opening of the plurality of sub-vent openings includes a reinforcement strip extending along a portion of the bottom edge of the upper panel, the reinforcement strip maintaining the first sub-vent opening in an open state.

5. The lower-body garment of claim 4, wherein the first sub-vent opening is located on the front aspect of the first leg portion.

6. The lower-body garment of claim 4, wherein a longitudinal axis of the first sub-vent opening is oriented substantially perpendicular to the front midline of the lower-body garment.

7. A lower-body garment having a torso region defining a waist opening, the lower-body garment comprising:

a first leg portion extending from the torso region and having a distal opening, the first leg portion comprising:

an upper panel having a top edge adjacent a crotch region and a bottom edge and extending horizontally and at least partially across a back aspect of the first leg portion, around a medial aspect of the first leg portion, and at least partially across a front aspect of the first leg portion, the top edge of the upper panel spaced apart from the crotch region of the lower-body garment where the crotch region is located where the first leg portion extends from the torso region of the lower-body garment;

a lower panel having a top edge and extending horizontally and at least partially across the back aspect of the first leg portion, around the medial aspect of the first leg portion, and at least partially across the front aspect of the first leg portion, wherein the bottom edge of the upper panel overlaps the top edge of the lower panel from 4 mm to 4 cm to form a vent opening between the bottom edge and the top edge, wherein the vent opening extends continuously in a horizontal direction from a portion of the front aspect around the medial aspect and to the back aspect of the first leg portion and wherein a mesh liner layer is positioned internal to the upper panel and the lower panel, wherein the lower panel begins at the vent opening, which is between the bottom edge of the upper panel and the top edge of the lower panel, and ends at a location midway between the crotch region and an end of the first leg portion, and wherein at least a first front panel that extends from adjacent the waist opening of the torso region to the distal opening of the first leg portion.

8. The lower-body garment of claim 7, wherein at least the lower panel includes a first terminal end located on the front aspect of the first leg portion.

9. The lower-body garment of claim 8, wherein the first front panel extends across a first reference line that passes through the first terminal end of the lower panel and is parallel to a front midline of the lower-body garment.

10. The lower-body garment of claim 7, further comprising a plurality of securement points between the bottom edge of the upper panel and the top edge of the lower panel, the plurality of securement points subdividing the vent opening into a plurality of sub-vent openings.

11. The lower-body garment of claim 10, wherein a first sub-vent opening of the plurality of sub-vent openings includes a reinforcement strip extending along a portion of the bottom edge of the upper panel, the reinforcement strip maintaining the first sub-vent opening in an open state.

12. The lower-body garment of claim 11, wherein the first sub-vent opening is located on the front aspect of the first leg portion.

13. The lower-body garment of claim 7, further comprising:

a second leg portion extending from the torso region and having a distal opening, the second leg portion comprising:

an upper panel having a bottom edge and extending horizontally and at least partially across a back aspect of the second leg portion, around a medial aspect of the second leg portion, and at least partially across a front aspect of the second leg portion;

a lower panel having a top edge and extending horizontally and at least partially across the back aspect of the second leg portion, around the medial aspect of the second leg portion, and at least partially across the front aspect of the second leg portion, wherein the bottom edge of the upper panel overlaps the top edge of the lower panel to form a vent opening between the bottom edge and the top edge; and at least a second front panel that extends from adjacent the waist opening of the torso region to the distal opening of the second leg portion.

* * * * *